United States Patent [19]

Lim

[11] Patent Number: 4,710,045

[45] Date of Patent: Dec. 1, 1987

[54] DIASYWHEEL PRINTER WITH IMPROVED ADJUSTABLE CARRIAGE ASSEMBLY AND CARTRIDGE LATCHING MEMBER

[75] Inventor: Sam K. Lim, San Jose, Calif.

[73] Assignee: Genicom Corporation, Waynesboro, Va.

[21] Appl. No.: 841,080

[22] Filed: Mar. 18, 1986

Related U.S. Application Data

[60] Division of Ser. No. 762,021, Aug. 1, 1985, which is a continuation of Ser. No. 538,606, Oct. 3, 1983.

[51] Int. Cl.[4] ..... B41J 11/22; B41J 11/20; B41J 19/56

[52] U.S. Cl. ..... 400/352; 400/59; 400/242; 400/335; 400/356; 292/254; 29/530; 248/273

[58] Field of Search ..... 400/637.1, 642, 647.1, 400/354, 356, 691, 693, 694, 352, 353, 355, 208, 242, 243, 692, 335, 320; 292/254; 29/530; 248/27.3

[56] References Cited

U.S. PATENT DOCUMENTS

| | | | |
|---|---|---|---|
| 4,049,109 | 9/1977 | Plazo et al. | 400/356 |
| 4,134,695 | 1/1979 | Randolph | 400/356 X |
| 4,408,914 | 10/1983 | Ciesel et al. | 400/208 |
| 4,468,144 | 8/1984 | McMahon et al. | 400/354 |
| 4,512,674 | 4/1985 | Suzaki et al. | 400/357 X |
| 4,530,611 | 7/1985 | Borcenk et al. | 400/357 X |
| 4,531,852 | 7/1985 | Mädge et al. | 400/356 X |
| 4,576,496 | 3/1986 | Schwarz et al. | 400/352 |

FOREIGN PATENT DOCUMENTS

| | | | |
|---|---|---|---|
| 1139853 | 11/1962 | Fed. Rep. of Germany | 400/357 |
| 2913683 | 10/1980 | Fed. Rep. of Germany | 400/352 |

*Primary Examiner*—Charles A. Pearson
*Assistant Examiner*—James R. McDaniel
*Attorney, Agent, or Firm*—Nixon & Vanderhye

[57] ABSTRACT

An adjustable carriage assembly for a printing device having a print mechanism to be translated along a linear print path. The carriage assembly includes an upper carriage sub-assembly and a lower carriage sub-assembly, the lower carriage sub-assembly having a pair of laterally spaced arm members joined together by a pair of cross members. Each arm member has an open pivot slot and a support ramp portion. A spring coupled between the upper and lower carriage sub-assemblies in the region adjacent the pivot portions provides a spring detent for the upper carriage sub-assembly with respect to the lower carriage sub-assembly in both the first operative position and a second inoperative position. The guide members are adjustable eccentric washers.

A cartridge latch is configured to be removably mounted in an aperture formed in a platform on the upper carriage sub-assembly. The latch comprises a unitary member having a lower U-shaped portion with one leg terminating at an upper end in an outwardly extending flange and the other leg having an outwardly extending keeper nib located below oppositely extending flange portions and spaced therefrom, an upper portion having a cartridge abutment surface, and a relatively stiff web portion joining the upper portion to the top surface of the flange portions.

6 Claims, 23 Drawing Figures

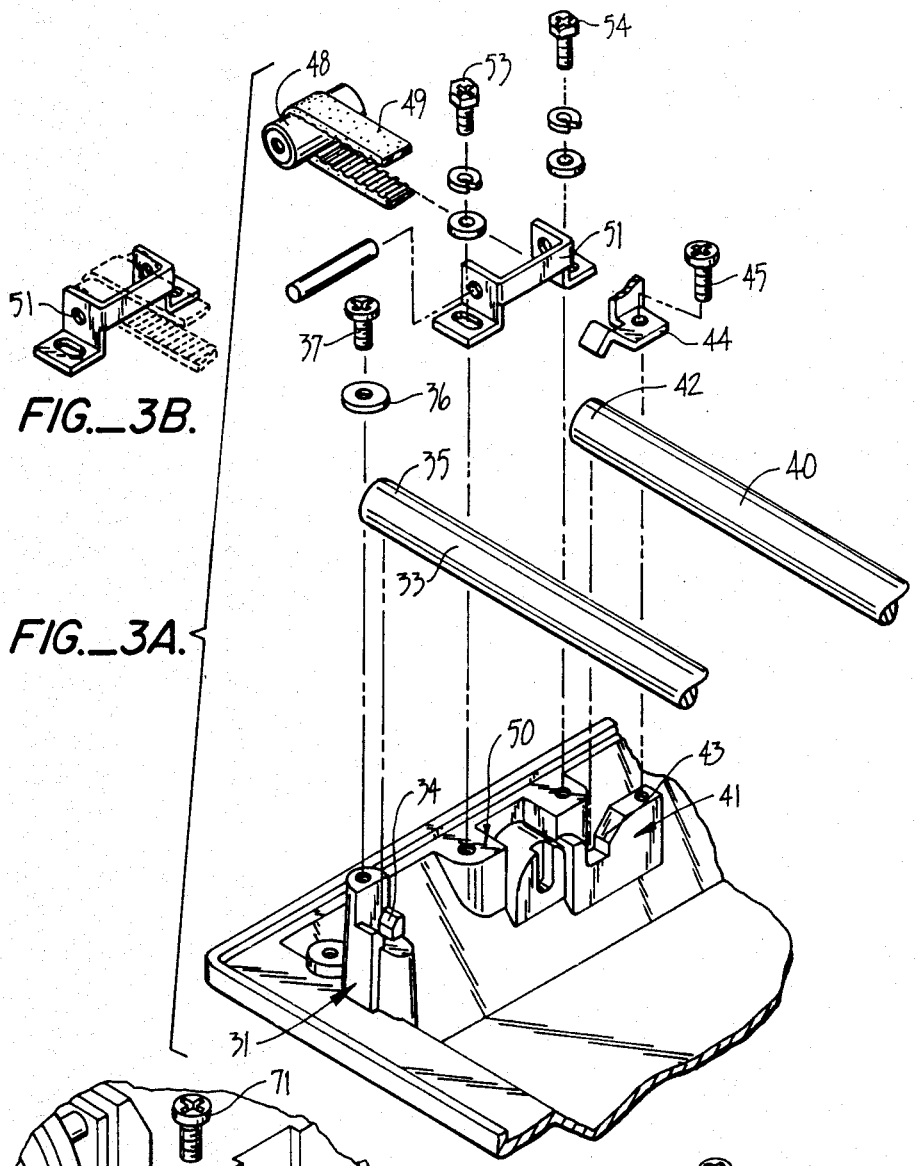
FIG._3A.
FIG._3B.
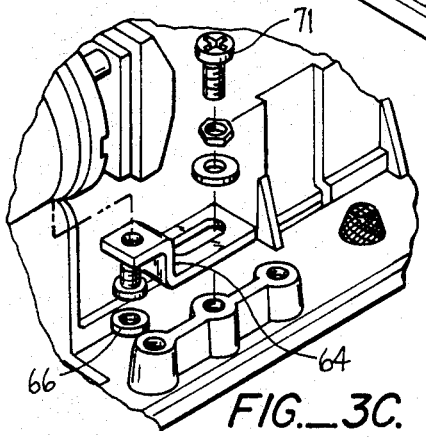
FIG._3C.
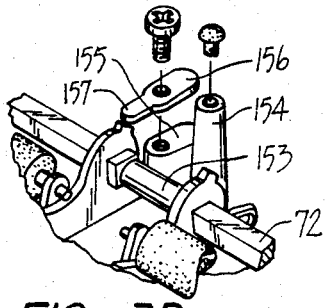
FIG._3D.

DIASYWHEEL PRINTER WITH IMPROVED ADJUSTABLE CARRIAGE ASSEMBLY AND CARTRIDGE LATCHING MEMBER

STATEMENT OF RELATED CASE

This application is a divisional application of U.S. patent application Ser. No. 762,021 filed Aug. 1, 1985 for Daisywheel Printer with Improved Mounting for Mechanical Elements, which is a continuation of application Ser. No. 538,606 filed Oct. 3, 1983 for Daisywheel Printer.

BACKGROUND OF THE INVENTION

This invention relates to electromechanical printers of the type having a rotary print wheel mounted on a translatable carriage, commonly known as "daisy wheel printers".

Printing devices are known which employ a rotary print wheel mounted on a carriage for translation across the width of the print throat area for character printing. The carriage is typically mounted for sliding movement along a pair of spaced guide rods arranged in parallel fashion to the axis of a rotatable platen, and the print wheel is typically removably carried by the output shaft of a motor mounted to the carriage for translation therewith. A print hammer assembly is typically mounted above the print wheel motor, along with a support plate and driving mechanism for a removable ribbon cartridge. The removable ribbon cartridge typically contains either an endless ribbon or a ribbon mounted on a pair of reels. These mechanical mechanisms are typically contained within a printer housing, along with a carriage drive motor, motion translation mechanisms such as belts or cables and pulleys mechanically coupled between the carriage drive motor and the carriage, a platen stepper motor, a motion translating mechanism coupled between the platen stepper motor and the platen for providing paper feed around the platen, a paper deflector and pressure rollers, a mechanism for operating the platen pressure rollers, various switches and the electronic circuitry required to operate the mechanical components of the printer.

In the past, the carriage typically included a plurality of individual arm and platform members fastened together with individual fasteners and providing an upper carriage assembly and a lower carriage assembly pivotably mounted with respect to one another.

The removable ribbon cartridge is normally supported on a platform using some type of releasable latching mechanism, which enables a spent cartridge to be removed and replaced by a fresh cartridge. While several latching mechanisms are known, all suffer from one or more disadvantages, which include multi-element latches requiring the separate assembly of individual component parts, the use of separate guide posts or mechanical cartridge stops for registration purposes, and interally molded, frangible loction studs.

SUMMARY OF THE INVENTION

The invention comprises an improved carriage assembly which affords a relatively simple adjustment device for relative positioning of upper and lower carriage sub-assemblies, and an extremely simple carriage latch device.

In a first aspect, the invention further includes an improved carriage assembly having upper and lower carriage means requiring only a small number of mechanical parts. The lower carriage means supports the upper carriage means and comprises a unitary member having a pair of laterally spaced arm members each provided with a pivot slot and a support ramp portion, a rear tube portion joining the arm members at the rear, and a front cross brace joining the arm members in the front. The rear tube portion is dimensioned to accommodate a first carriage support rod, and the front cross brace supports a front bearing means dimensioned to accommodate a second carriage support rod. The upper carriage means includes a pair of laterally opposed support studs, each received in a different one of the pivot slot and a pair of laterally opposed guide members, each located rearwardly of the respective one of the support studs, the guide members normally engaging corresponding support ramp portions when the carriage assembly is in a first operative position. Spring means are coupled between the upper and lower carriage means in the region adjacent the pivot portions, the spring means being arranged for over center travel to provide a spring detent for the upper carriage means with respect to the lower carriage means in the first operative position and in a second inoperative position. In the preferred embodiment, the guide members are adjustable eccentric washers which afford a simple but accurate adjustment for the relative position between the upper and lower carriage means.

In a further aspect of the invention, an improved ribbon cartridge releasable mechanical latch is provided which is constructed from a single moulded piece of suitable material, such as Delrin, and which provides the usual ribbon cartridge latching function with a single unitary part.

The cartridge latch comprises a unitary member having a lower U-shaped portion with one leg terminating at an upper end in an outwardly extending flange and the other leg having an outwardly extending keeper nib located below oppositely extending flange portions and spaced therefrom, an upper portion having a cartridge abutment surface, and a relatively stiff web portion joining the upper portion to the top surface of the flange portions. The upper portion of the latch includes a substantially flat floor portion, an upwardly extending angled wall portion joined to the floor portion along an edge, a top portion joined to the upper edge of the wall portion, and a vertical web extending between the top portion and the floor portion. The top portion preferably has a serrated upper surface, and the vertical web is preferably aligned above the relatively stiff web portion.

The guide member aspect of the invention provides a relatively accurate adjustable positioning mechanism to control the relative spacing between the upper carriage and the lower carriage and is relatively simple to install and adjust without the need for substantial technical expertise. The latch aspect of the invention provides an extremely simple, low cost latching device which is relatively simple to install and which provides an efficient releasable latching operation for the removable cartridge.

For a fuller understanding of the nature and advantages of the invention, reference should be had to the ensuing detailed description taken in conjunction with the accompanying drawings.

BRIEF DESCRIPTION OF THE DRAWINGS

FIG. 3A is an enlarged detail view of the integral carriage rod support elements and retainers;

FIG. 3B is a perspective view of the pulley bracket;

FIG. 3C is an enlarged detail view of an optional carriage motor support mechanism;

FIG. 3D is an enlarged detail view of the control rod central retainer;

DESCRIPTION OF THE PREFERRED EMBODIMENT

Figure 1:
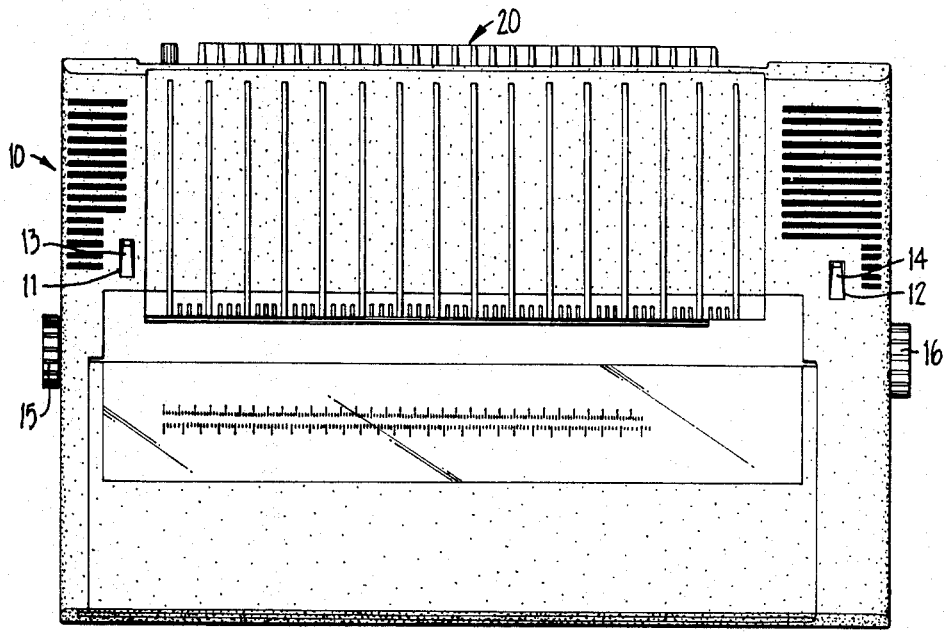
FIG. 1 is a top elevational view of a printer incorporating the invention.

Turning now to the drawings, FIG. 1 illustrates a daisy wheel printer incorporating the invention with the finishing cover installed. As seen in this Fig., the printer includes a finishing cover generally designated with reference numeral 10 for enclosing the internal components of the printer. Cover 10 is provided with a pair of apertures 11, 12 for accommodating a pair of manually operable levers: a paper bail lever 13, and a platen pressure roller lock and release lever 14 described in more detail below. A pair of platen operating knobs 15, 16 releasably mounted on opposite ends of the platen shaft (illustrated below) are arranged at opposite sides of the housing cover 10. Visible in FIG. 1 is a ribbed heat sink portion of the base structure generally designated with reference numeral 20.

Figure 2:
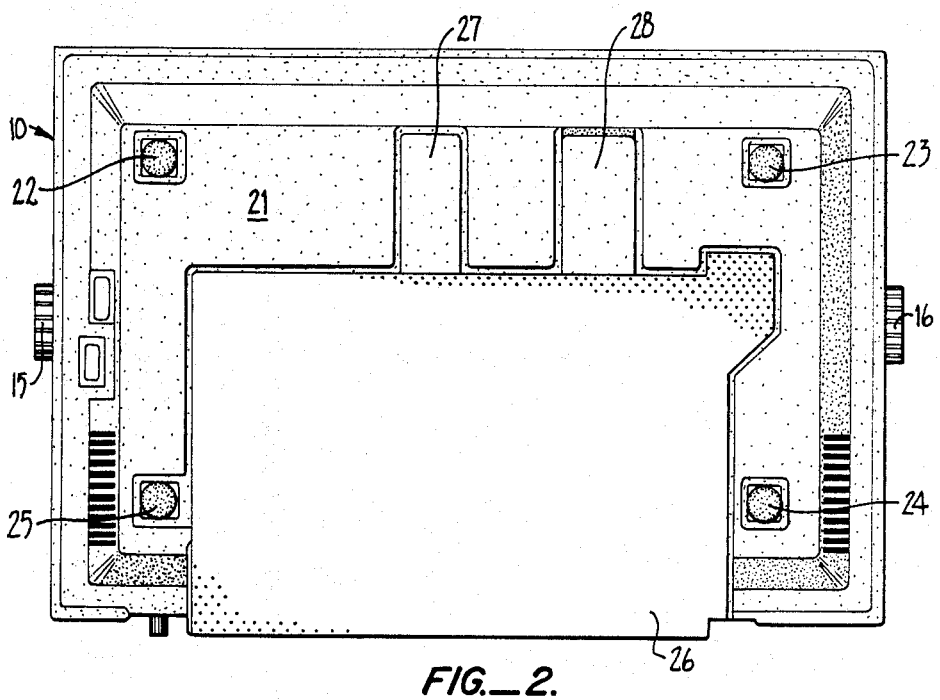
FIG. 2 is a bottom elevational view of the printer of FIG. 1.

With reference to FIG. 2, the side walls of the finishing cover 10 generally surround an integrally cast metal base member generally designated with reference numeral 21 provided with four vibration dampening support feet 22–25. A bottom metal cover plate 26 is also provided to enclose a printed circuit board recess (described below), plate 26 also serving to partially capture a pair of auxiliary cover plates 27, 28 (illustrated fully in FIG. 4).

Figure 3:
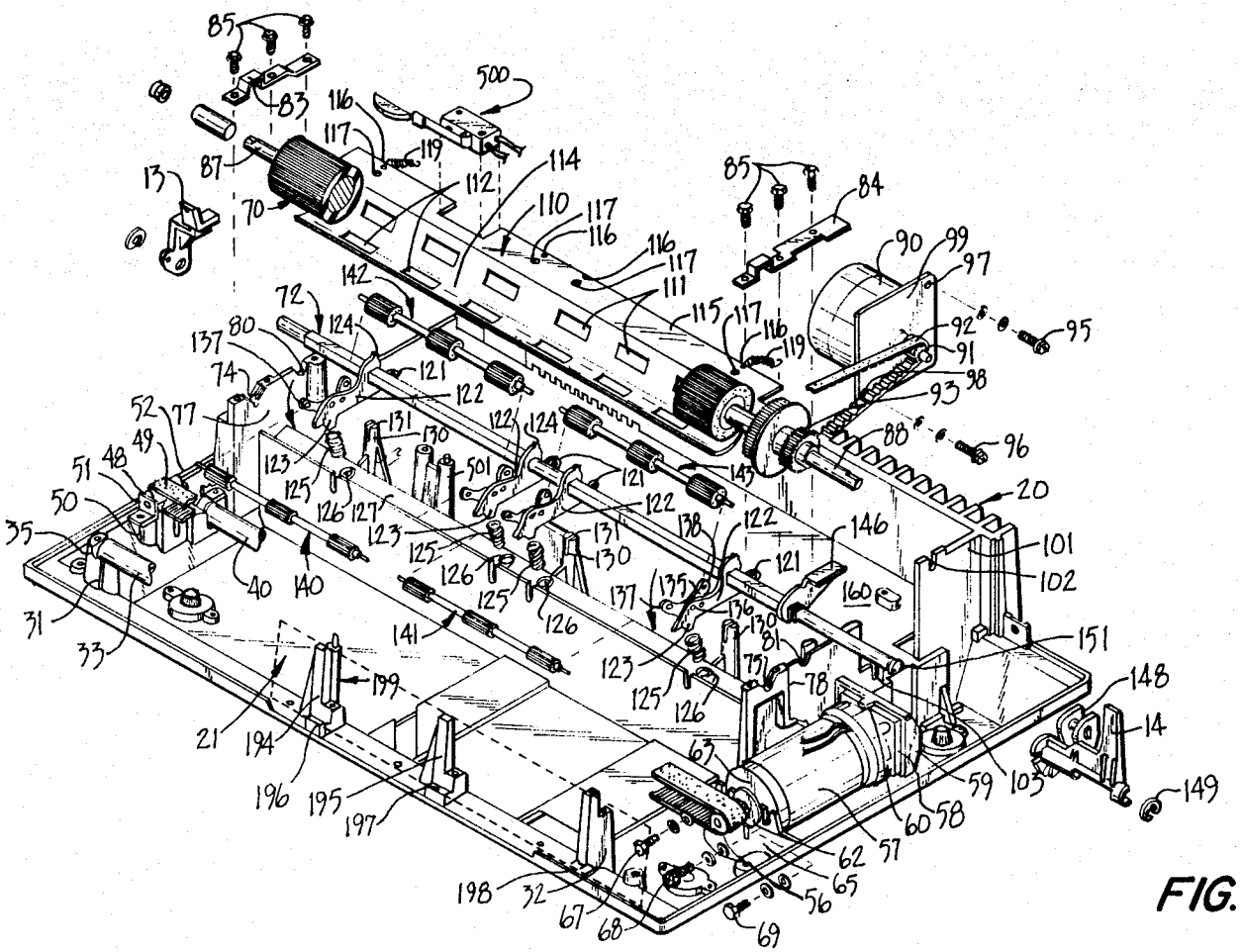
FIG. 3 is a first exploded isometric view of the printer of FIG. 1 with the cover and certain elements removed and other elements partially broken away.

With reference to FIG. 3, the integral cast base 21 is formed in a unique shape incorporating all of the major mounting support elements for the mechanical and electromechanical components of the printer. In particular, a first pair of support posts 31, 32 are formed along the forward portion of the base 21 near the corners to provide vertical support for a first carriage guide rod 33 extending therebetween. The contour of support post 31 is illustrated in FIG. 3A and is seen to comprise a generally notched central portion 34 for receiving the end 35 of of the forward carriage guide rod 33. The configuration of the central portion of support post 32 is identical to that of 31. The end 35 of forward carriage guide rod 33 is anchored in place by means of a keeper element 36 and a fastener 37.

Also with reference to FIGS. 3 and 3A, a rear carriage guide rod 40 is similarly supported by means of an integrally moulded guide 41 and a corresponding guide hidden from view in FIG. 3, guide 41 having a notched central portion 43 for receiving the end 42 of the rear carriage guide rod 40. The rear carriage guide rod is secured in place in the support 41 by means of a keeper 44 forming part of a bail mechanism (described below) and a threaded fastener 45. The right end of rear carriage guide rod 40 is similarly secured.

A ball bearing cylindrical pulley 48 for the carriage drive belt 49 is secured to a support member 50 integrally formed in the base by means of a bracket 51 and threaded fasteners 53, 54. The other end of the carriage drive belt 49 is received about a driving gear 56 secured to the output shaft of a DC servo motor 57. Servo motor 57 has a rear location portion 58, generally rectangular in shape, which is received by a cover member 59 having a stop tab 60 extending forwardly of the unit. The forward end of motor 57 has a mounting boss 62 formed in the front plate 63 and received in a circular cradle formed in a support partition 65 integrally formed in the base 21. Three threaded fasteners 67–69 are used to secure the motor 57 to the support 65, each fastener 67–69 passing through a separate slot formed in support 65 and being received in a threaded aperture in plate 63. If desired, a rear support bracket 64 (FIG. 3C) may be installed at the rear of motor 57, the bracket 64 being secured to a hidden threaded aperture by means of screw 66 and to the base 21 by means of a fasterner 71.

The platen 70 and a pressure roller operating rod 72 are each mounted in a different pair of cradles: the platen support cradles 74, 75 are each formed in a forward portion of a pair of integral support walls 77, 78; while the ends of the pressure roller operating rod 72 are received, respectively, in notched portions 80, 81 of support members 77, 78. Both the platen 70 and control rod 72 are captured in their mounts by means of a single pair of keepers 83, 84 secured to the upper surface of the support walls 77, 78 by threaded fasteners 85.

The platen 70 can be either manually operated by means of knobs 15, 16 (FIG. 1) which are fitted onto the opposite ends 87, 88 of the platen assembly 70, or automatically by means of a stepper motor 90 having an output gear 91 and a timing belt 92 received about the output gear 91 and a platen drive gear 93. Stepper motor 90 is secured to the base 21 by means of a pair of threaded fasteners 95, 96 each arranged to be threaded into a different aperture 97, 98 formed in the stepper motor 90 end plate 99. Fastener 95 is arranged to draw end plate 99 against a first integral support partition 101 having a groove 102 for accommodating the shank of fastener 95, while fastener 96 draws end plate 99 against support wall 78 having groove 103 for accommodating fastener 96.

A paper deflector 110 is provided with first and second series of rectangular apertures 111, 112 in order to receive the paper pressure rollers described below. Deflector 110 has a generally cylindrical curved surface portion 114 and a flat flange portion 115 provided with a plurality of spring apertures 116 and a second plurality of clearance apertures 117. The spring apertures 116 each receive a first end of one of a plurality of bias springs 119. The other end of each of the bias springs 119 is received in a rear aperture 121 of one of a plurality of rocker arms 122 mounted on the control shaft 72. The forward end of each rocker arm 122 has a downwardly depending tab 123 for receiving the upper end of a bias spring 125. The other end of each bias spring 125 is received in a cuplike recess 126 integrally formed in a ledge portion 127 of base 21. A corresponding plurality of guideposts 130, each having a guide slot 131 is formed integrally with base 21 just to the rear of ledge 127 to provide lateral guides for the lower rearward portion of the rocker arms 122 when control shaft 72 is operated by means of lever 14.

Each rocker arm 122 includes a pressure roller support member 135 pivotally mounted to the rocker arm 122 by means of a rivet 136 for pivotally retaining member 135 to the rocker arm 122. Each pressure roller assembly support member 135 has a forward aperture 137 and a rear aperture 138 for supporting a first pair of smaller pressure roller assemblies 140, 141 and a second pair of larger pressure roller assemblies 142, 143. For example, left smaller pressure roller assembly 140 is received in the apertures 137 of the two leftmost pivotable support members 135 (one end in each), and the right smaller pressure roller assembly 141 is similarly carried by the two rightmost support members 135. Similarly, larger leftmost support roller assembly 142 is carried by the two leftmost support members 135 by the ends of assembly 142 being received in rear apertures 138; while larger rightmost pressure roller assembly 143 is similarly arranged in the two rightmost support members 135.

Figure 9:
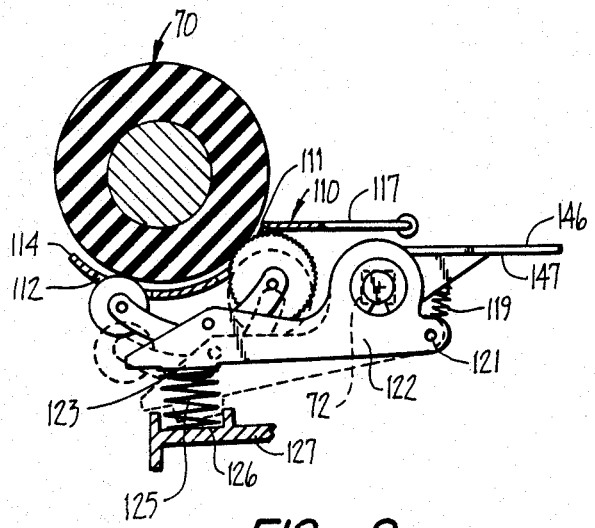
FIG. 9 is a right edge view illustrating the platen pressure roller actuating mechanism.

The pressure roller assemblies 140–143 are brought into pressure contact with the external surface of platen 70 (or a sheet of paper therebetween) and manipulated out of pressure contact by means of the pressure roller lever 14 described below in conjunction with FIGS. 12–14, and a cam lever 146 having a lower guide surface 147 (FIG. 9). When the lever 14 is pulled forwardly of the unit, shaft 72 is forceably rotated which causes the rocker arms 122 to rotate in the counter-clockwise direction as viewed in FIG. 9 against the normal bias force of bias springs 125. Rotation of shaft 72 in this manner causes the pressure roller assemblies 140–143 to be retracted away from the platen 70 surface. When the lever 14 is pushed rearwardly of the printer, the opposite action occurs, with the individual pressure rollers being received through their apertures 111, 112 in deflector 110. During rocking motion of the rocker arms 122, apertures 117 in paper deflector 110 provide sufficient clearance for the location nibs 124 to maneuver.

Lever arm 14 is retained on the control shaft 72 by means of a spring clip 149 received in a clip recess 151 formed in the right end of shaft 72.

In order to prevent bowing of the rounded central portion 153 of control shaft 72, a central support post 154 shown in FIG. 3D is integrally formed in base 21. Post 154 has a ledge 155 with a threaded aperture for supporting the rear portion of a keeper tab 156 having a tongue portion 157 for applying downward pressure on the grounded central portion 153.

Base 21 has an upper rear platform portion 160 located rearwardly of the control rod 72 and paper deflector 110, which platform provides a support surface for a first group of electronic components which comprise the power generating components and thus the principal source of heat during electrical operation of the printer. This platform 160 terminates at the rearward edge in the ribbed thermal mass 20 to provide an integral heat sink for the electrical power components. In addition, the lateral support wall 101 in combination with the platform section 160 and the upstanding rear wall portion 20 provide radiation shielding for the electrical components to be mounted therein. Further, since the entire base 21 is cast from an electrically conductive metal, any static charges in the interior of the printer thus far described dissipate on the metal base 21.

As thus far described, it will now be apparent that the mechanical elements described above can be quickly mounted to the base 21 as an entire assembly with very little effort and technical expertise. The provision of the integrally moulded support sections for the major subcomponents of the printer provides an automatic location feature for these elements. As will further be apparent, should total or partial disassembly of the mechanical portion thus far described become necessary, this may be easily accomplished again with a minimum of effort. In this connection, it is noted that, in the event of a paper jam, the paper deflector can be easily removed from the top of the machine by simply removing the cover, releasing the pressure rollers (manipulating lever 14 to the forwardmost position), and disconnecting springs 119, without the necessity of disturbing the platen 70.

Figure 4:
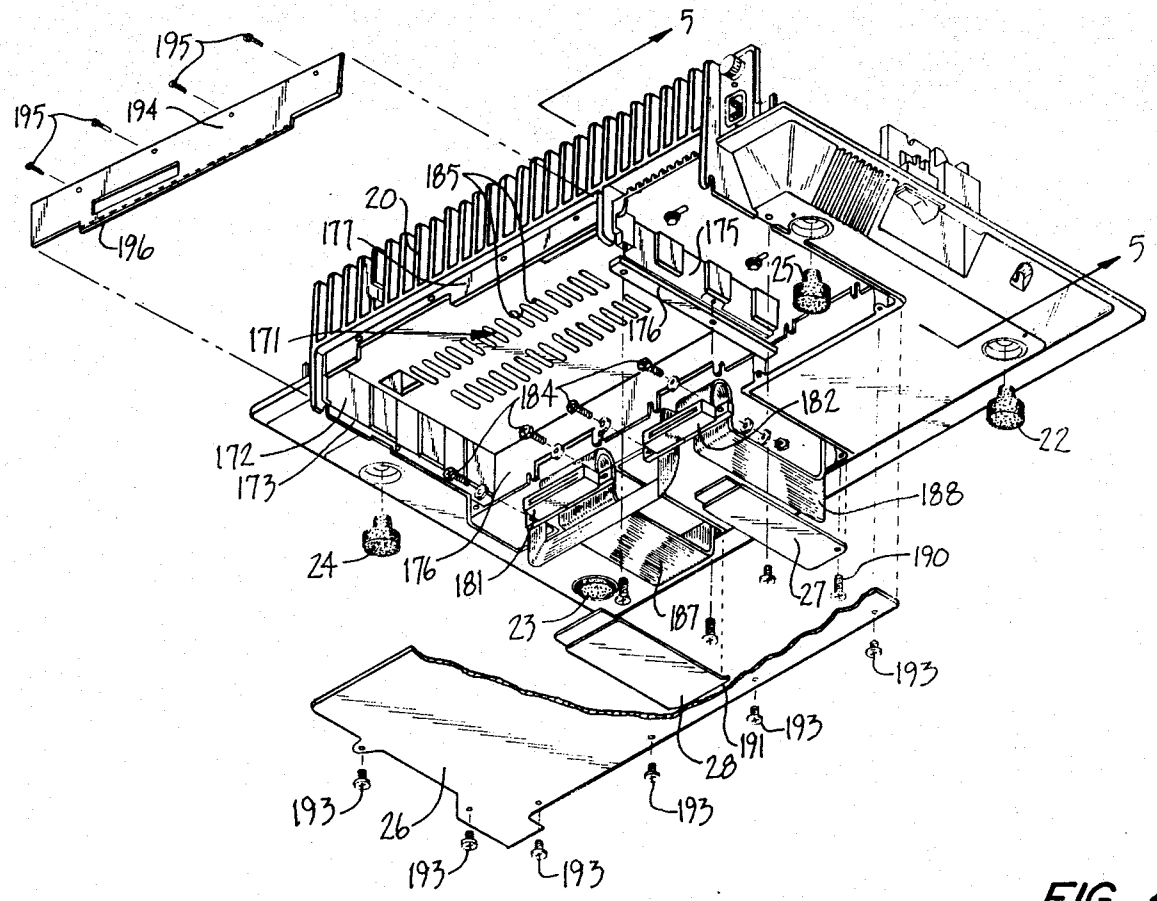
FIG. 4 is an exploded bottom isometric view of the printer of FIG. 1 with the bottom plate partially broken away.
Figure 5:
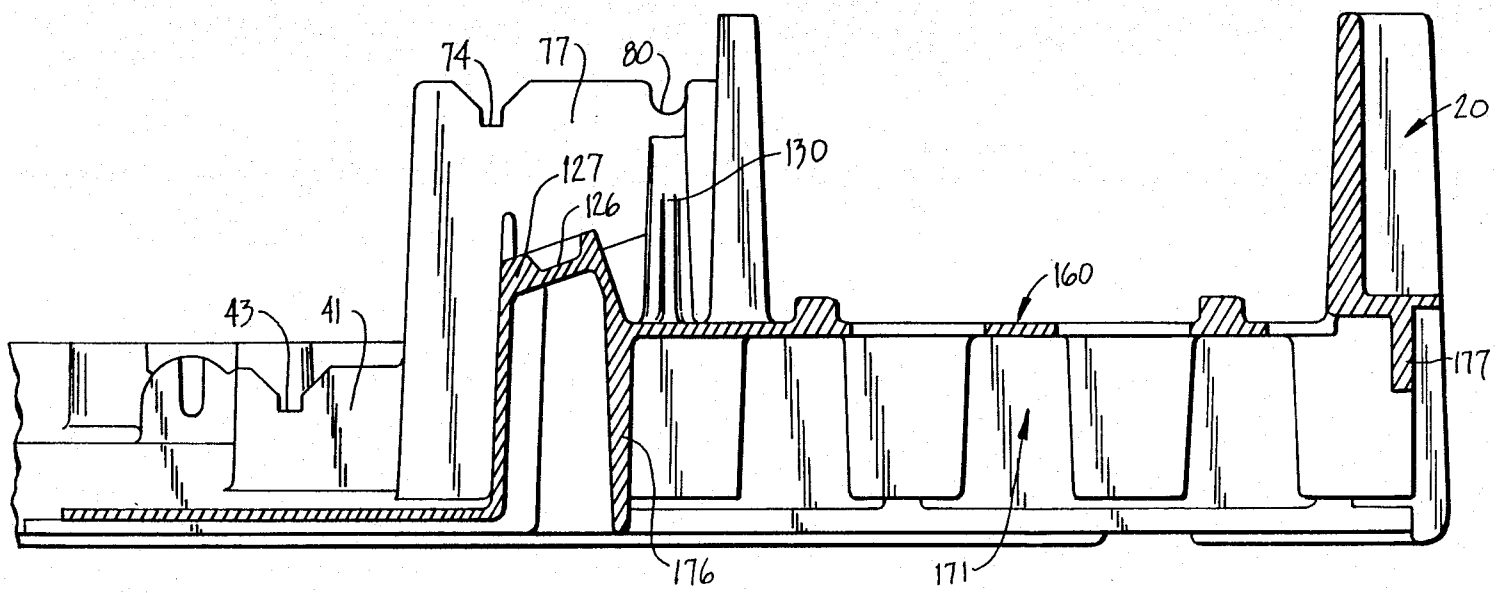
FIG. 5 is a sectional view taken along lines 5—5 of FIG. 4.

With reference to FIG. 4, the bottom mechanical components of the printer are seen. Base 21 has a bottom cavity generally designated by reference numeral 171 formed in the rear portion thereof. The purpose of cavity 171 is to accommodate the control electronics board (not shown). Formed in the exposed sidewall 172 of cavity 171 is a slot 173 for slidably receiving one edge of a printed circuit board. Secured to the underside of the other integral sidewall 175 is a slider bar 176 which provides the other ledge for the printed circuit. A pair of connector blocks 181, 182 are mounted to the forward edge of the enclosure 171 by means of fasteners 182 which are threaded into apertures in the blocks 181, 182 and serve to clamp the blocks against the forward wall 176 of the volume 171. It is noted that the upper surface of volume 171 is the bottom surface of platform 160 (FIG. 3). A plurality of apertures 185 are formed through this surface to provide thermal communication between the volume 171 and the surface above platform 160.

Attached to connector blocks 181, 182 are ribbon cables 187, 188 which provide electrical connections between the control board and the electrical components mounted on the top side of the base 21. Cables 187, 188 are protected by plates 28, 27 respectively.

Plate 27 is partially secured in place by means of threaded fastener 190, while plate 28 is partially secured in place by an angled end portion 191 frictionally received in a ledge (not visible) formed in the lower surface of base 21. The other ends of plates 27, 28 are captured by the forward edge of plate 26, which is fastened to the underside of base 21 by means of a plurality of fasteners 193.

A separate heat sink plate 194 covers the rear casting wall in the region below integral heat sink portion 20, and is fastened in place by means of screws 195. Plate 194 has an inner slot suggested by the broken lines 196 which receives the rear edge of plate 26.

Radiation shielding for the control board located in volume 171 is provided by the integrally formed walls 172, 175, 176 and 177, the top surface of the volume 171 and large cover plate 26.

Figure 6:
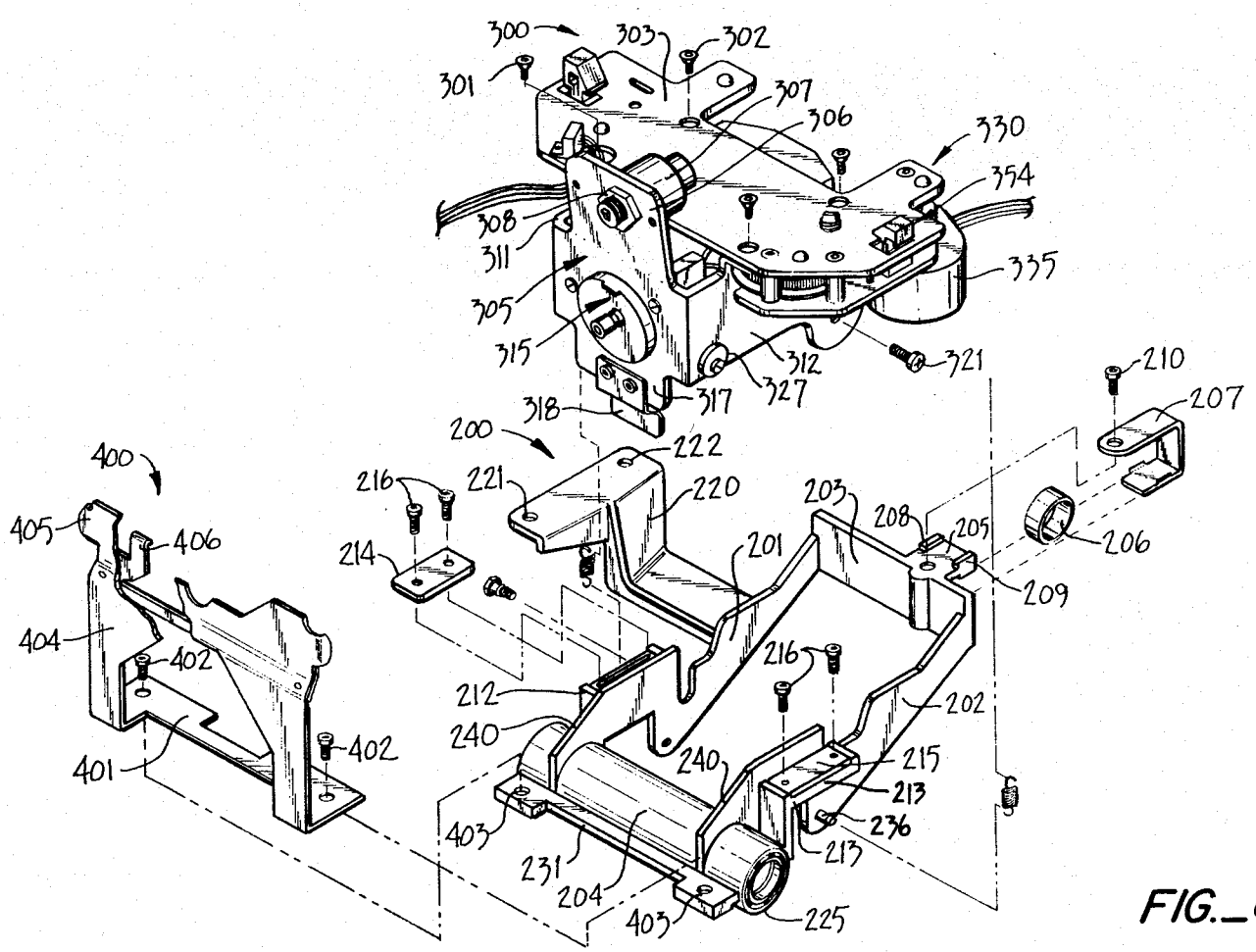
FIG. 6 is an exploded perspective view of the carriage and card/paper guide assemblies.

FIG. 6 illustrates the carriage assembly designed for use with the printer thus far described. The carriage assembly comprises three major subcomponents: a lower carriage assembly 200, an upper carriage assembly containing the print wheel hub and print wheel motor, hammer and ribbon cartridge platform assembly all generally designated with reference numeral 300 and a combined card/ribbon guide 400. The lower carriage assembly includes a laterally spaced pair of support arms 201, 202 joined in the rear by a support web 203 and joined in the front by a bearing tube 204. The construction of elements 201–204 is a one piece casting, which includes a rear extension 205 for receiving a rear rod guide bearing 206 suspended therebelow by means of a generally U-shaped clip 207 with a forwardly extending tongue portion received between abutment edges 208, 209 and fastened to extension 205 by means of a fastener 210.

Figures 15, 16:
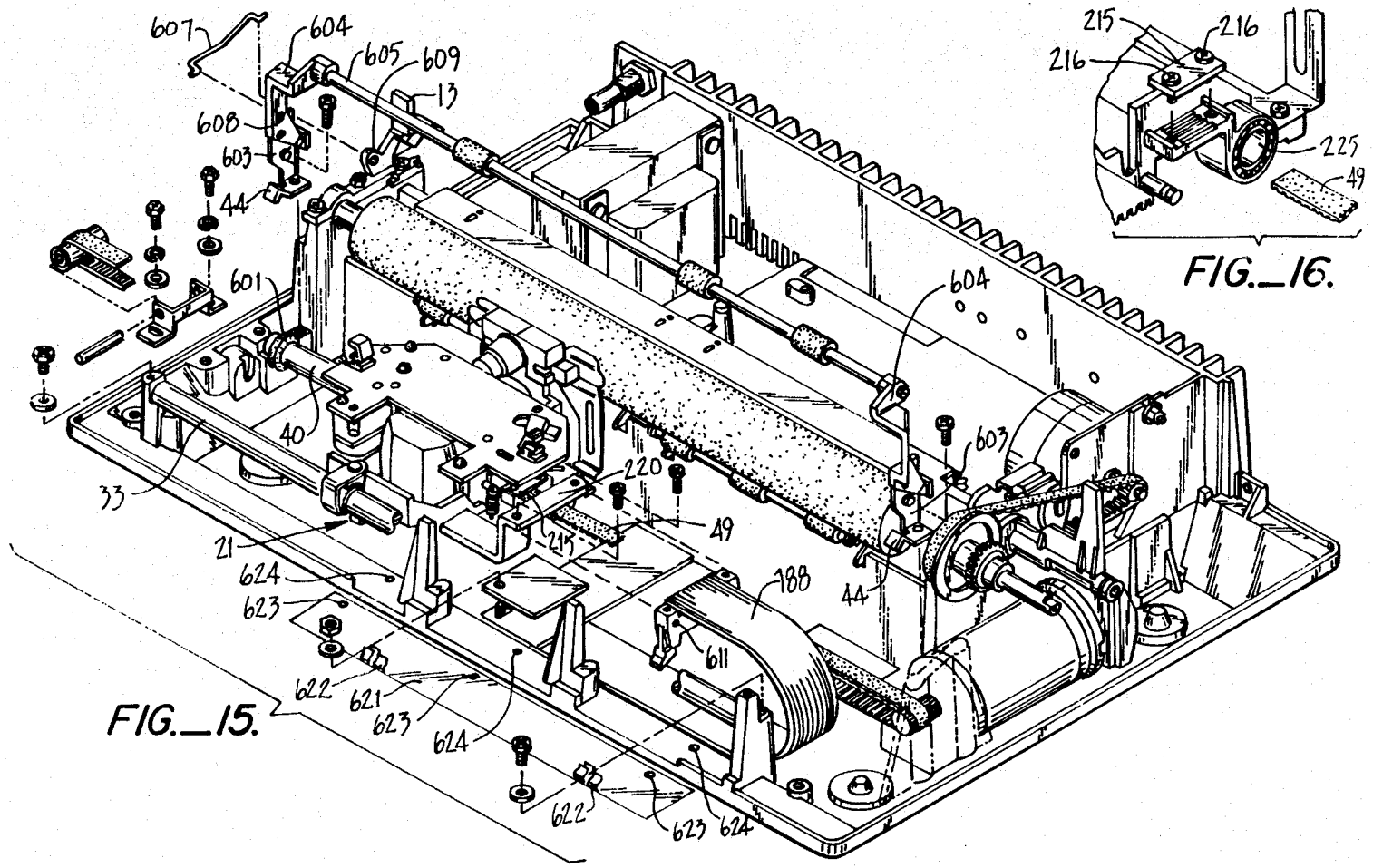
FIG. 15 is a view similar to FIG. 3 showing the carriage assembly and paper bail installed.
FIG. 16 is an enlarged detail view showing the carriage bolt fastening arrangement.

Arms 201, 202 are provided with outboard grooved lands 212, 213, each arranged to receive a keeper plate 214, 215 used to capture the carriage timing belt 49 (FIG. 16) by means of threaded fasteners 216. Extending laterally to the left of the arm 201 is a support bracket, also integrally formed with members 201–205, which provides support for a connector 611 secured to one end of cable 188 (FIG. 15).

Pressed into the open ends of bearing tube 204 are a pair of forward rod support bearings, only one of which (bearing 225) is illustrated in FIG. 6. An oil wetted felt washer is installed adjacent bearing 225 to keep rod 40 clean and lubricated, the washer being retained in tube 204 by means of an externally toothed push-in retainer ring. As will now be apparent, the lower carriage assembly is slidably supported on forward support rod 33 and rear support rod 40 (FIG. 3) by means of bearing 206 and bearing 225 (and its unseen left counterpart), and translated parallel to the platen 70 by means of the timing belt 49 secured by means of keepers 214, 215.

The upper carriage assembly includes a main support member 305 having an upwardly extending flange portion 306 for supporting the hammer solenoid 307 secured thereto by means of a locknut 308. Member 305 is generally shaped in the form of a unitary yoke pattern having a pair of sidewalls 311, 312 for supporting the print wheel motor (not shown) terminating in the print wheel hub 315 designed to receive a removable print wheel. Depending downwardly from a lower flange 317 is a spring clip 318 designed to provide a locking detent with the recessed wall portion 231 of the lower carriage frame.

Figure 7:
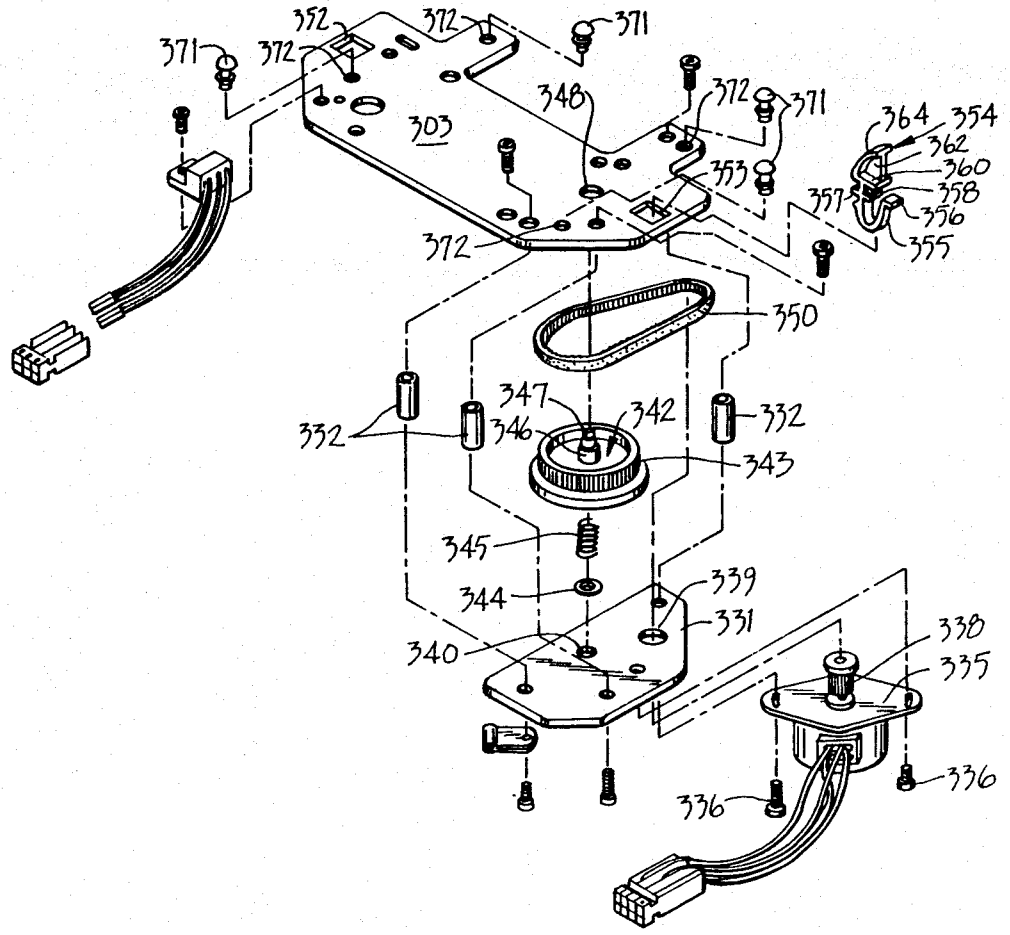
FIG. 7 is an exploded perspective view of the ribbon cartridge support and drive assembly.

Upper carriage assembly includes a ribbon drive assembly generally designated with reference numeral 330 and shown in detail in exploded view FIG. 7. As seen in this Fig., the ribbon drive assembly includes an upper support plate 303, a lower containment plate 331 and three spacer tubes 332 for providing adequate clearance with plate 303 for the ribbon drive components.

The ribbon drive components include a drive motor assembly 335 secured to the underside of plate 331 by means of a pair of fasteners 336 and having a driving gear on the output shaft 338 extending through a drive gear aperture 339 in plate 331. Rotatably mounted in a bearing aperture 340 is a ribbon drive pulley 342 having a ribbed or toothed pulley surface 343. Pulley 342 is lightly spring loaded by means of washer 344 and compression spring 345 to reduce friction between the bottom surface thereof and the top surface of plate 331. The upper end of the shaft 346 of pulley 342 terminates in a drive slot 347 which passes through a bearing aperture 348 in plate 303 so that the slot 347 protrudes above the upper surface of plate 303. When assembled, a drive belt 350 is received about the driving gear 338 and the pulley surface 343 to transfer motion from the motor 335 to the driving slot 347.

Figure 7A:
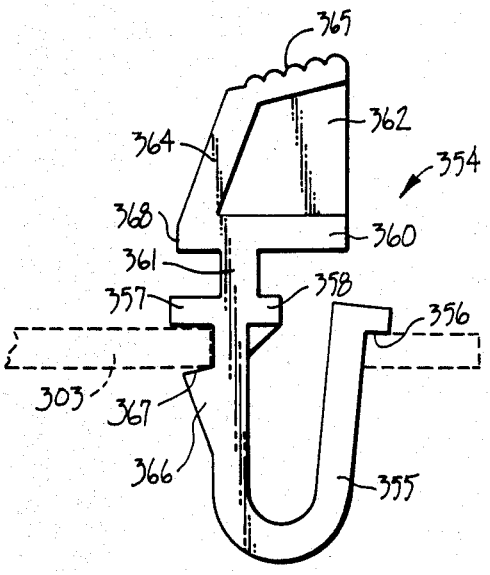
FIG. 7A is a side elevational view of the ribbon cartridge latch.
Figure 7B:
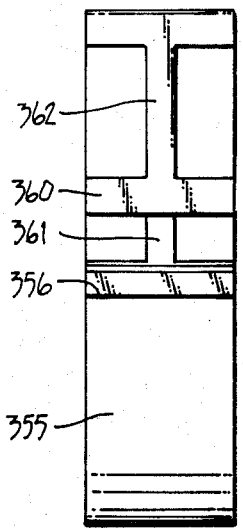
FIG. 7B is an end elevational view of the latch of FIG. 7A.

Press fitted into essentially rectangular apertures 352, 353 formed in plate 303 are a pair of ribbon cartridge latches 354, only one of which is illustrated. With reference to FIGS. 7A and 7B, the cartridge latch 354 is an integrally moulded element having a stiff but flexible capture leg 355 terminating in a retaining lip 356 for engaging the upper surface of plate 303. Latch 354 further includes a lower pair of oppositely laterally extending flanges 357, 358 and a vertically spaced flat surface portion 360 connected to the lower flanges 357, 358 by means of a web 361. A vertically arranged stiffener web 362 joins a curved surface portion 364 and a serrated upper portion 365 to the surface portion 360. Latch 354 further includes an angled keeper nib 366 having an upper abutment edge 367. Latch 354 is installed in plate 303 by inserting the leg 355 into aperture 352 or 353 until nib 366 clears the lower edge of plate 303. In this position, edge 367 retains latch 354 in the aperture against upward motion of the latch, while the lower surface of flange 357 and lip 356 prevent downward motion of the latch by virtue of contact against the upper surface of plate 303. Latch 354 is designed to be flexed away from the central portion of plate 303 when a cartridge is attached to the upper carriage assembly, the side wall of the cartridge being held by the corner portion 368 of latch 354. To release a cartridge, the upper portion of the latch 354 is manually flexed outwardly by means of serrated surface portion 365. Latch 354 is preferably moulded from Delrin.

The ribbon drive portion 330 of the upper carriage assembly is completed by four rubber cartridge bumpers 371, each of which is press fitted into a corresponding aperture 372 formed in the upper plate 303 and provides an upward compression force against the bottom surface of the ribbon cartridge to prevent rattling, buzzing or other vibrations during printer operation.

The combination card/ribbon guide 400 (FIG. 6) comprises a lower flange portion 401 affording a mounting surface to the lower carriage assembly by means of fasteners 402 arranged to be threadably engaged in corresponding apertures 403 formed in the extending ledge portion of element 204. The flange portion 401 is formed at essentially a right angle to the upstanding frame portion 404 terminating in the rear edge 405 of the upper guide portion. Secured to this portion by means of rivets or the like is the forward ribbon guide portion 406. The card/ribbon guide is formed from any suitable material, such as spring steel.

Figure 8:
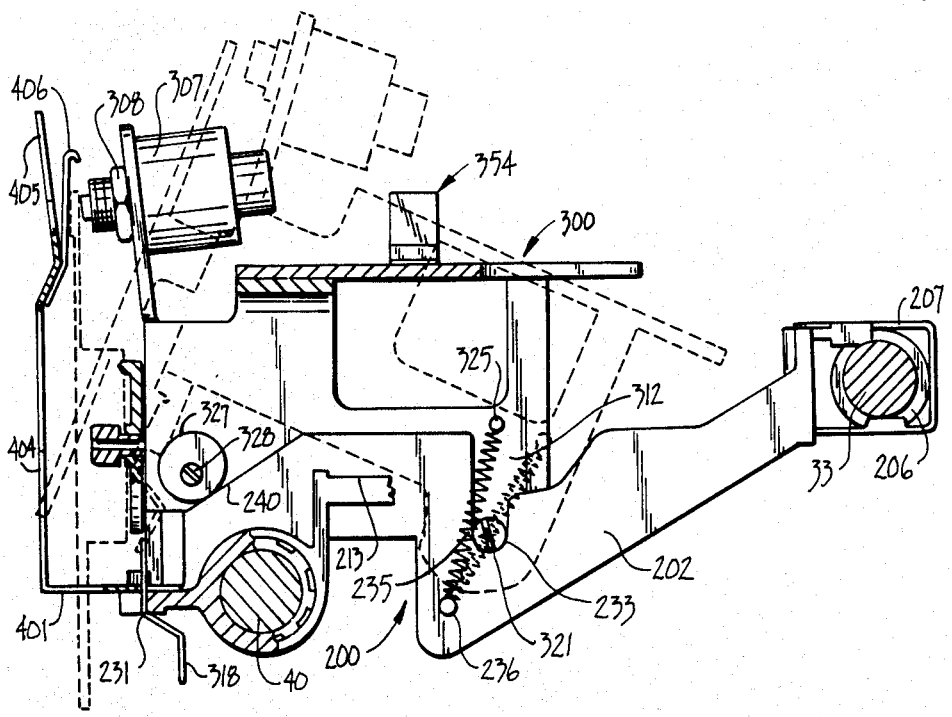
FIG. 8 is a right edge view, partially broken away of the carriage and print wheel.

FIG. 8 illustrates the manner in which the upper and lower carriage assemblies are operatively connected to one another. As seen in this Fig., a support stud 321 secured in support arm 312 is bottomed in a cradle slot 233 formed in arm 202. The unillustrated left side of the apparatus has comparable elements. A tension spring 235 is anchored at the lower end to a retaining post 236 in arm 202 at a point below the axis of stud 321. The upper end of tension spring 235 is attached to a support post 325 secured to arm 312. A guide washer 327 is secured to arm 312 by a screw 328 passing through an eccentric or off center aperture in washer 327. The hidden side of the carriage assembly is arranged with similar elements.

In the operative position illustrated in full in FIG. 8, the upper carriage assembly 300 is pivotally supported by stud 321 in slot 233. Springs 235 provide downward tension force to help maintain the carriage in the print position illustrated, and detent 318 provides a positive detent with edge 231. The eccentric washers 327 bear on the ramp edge 240 of side arms 202 and 201, and the attitude of upper assembly 300 relative to lower assembly 200 can be angularly adjusted.

When it is necessary to manipulate the carriage assembly to the nonworking position illustrated in broken lines in FIG. 8, the upper carriage assembly 300 is manually rotated to pivot about studs 321. As upper carriage assembly 300 rotates clockwise, as viewed in FIG. 8, the tension springs 235 pass over center with respect to stub axle 321 and provide a light detent force to hold the upper carriage assembly 300 in the open position.

Returning to FIG. 3, the forward portion of base 21 includes two additional integral support posts 194, 195 each having a support ledge 196, 197 which, along with ledge 198 of post 32 provide bottom bottom edge support for a control panel for the printer shown in phantom. The top edge of the control panel is clamped by means of bolt, nut and washer assemblies 199.

Figure 10:
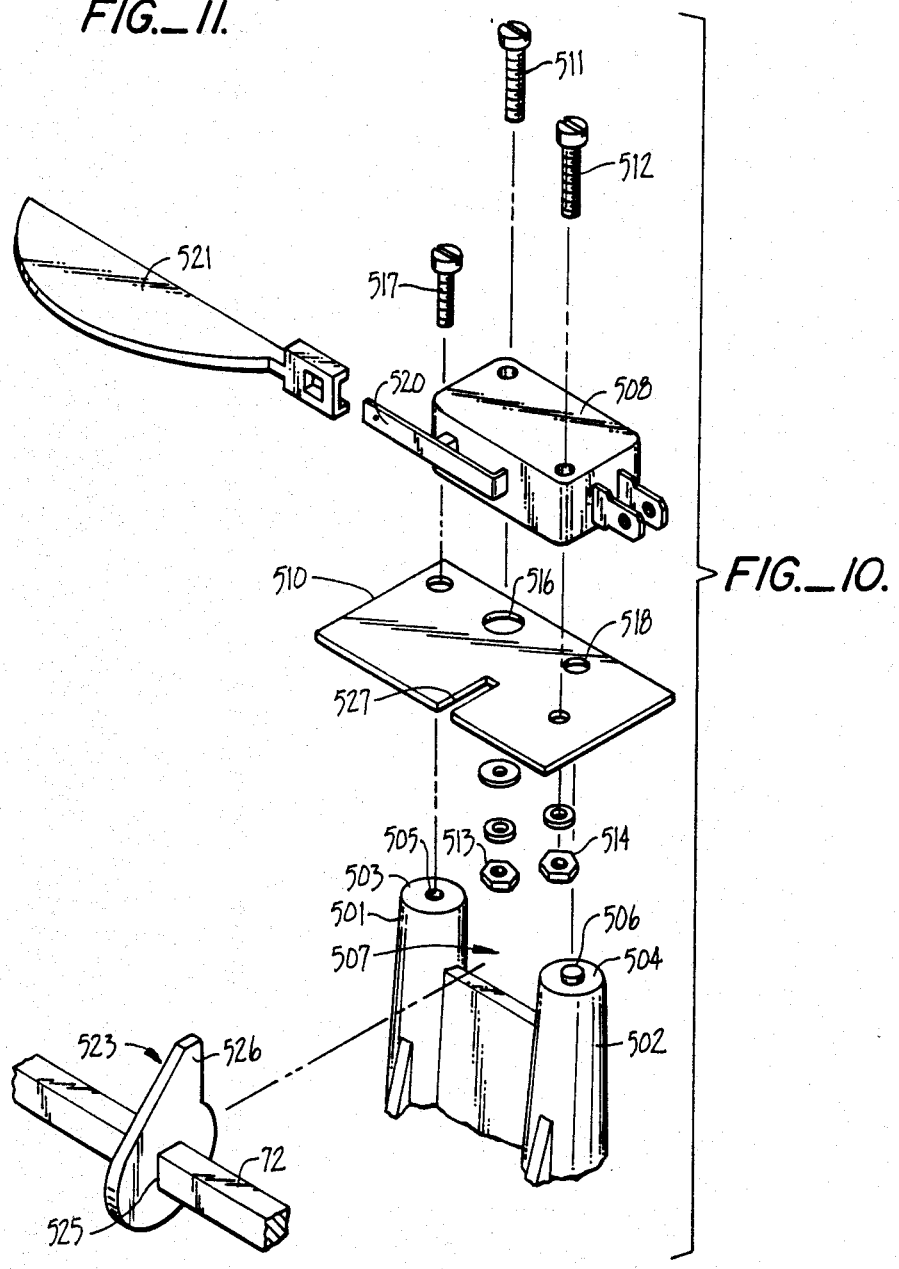
FIG. 10 is an enlarged detail view of an alternate embodiment of the paper-out switch.

With reference to both FIGS. 3 and 10, an out-of-paper switch assembly 500 includes a pair of integrally formed support posts 501, 502 each having a flat pedestal surface 503, 504. Surface 503 has a threaded aperture 505 and surface 504 has a location tang 506 flanking a central hollow portion 507. A microswitch 508 is secured to an intermediate adjustment plate 510 by means of screws 511, 512 and nuts 513, 514. Enlarged aperture 516 affords adjustability to the switch-plate assembly, which is secured to post 501 by means of screw 517 and secured against lateral movement by the interference fit provided by tang 506 and plate aperture 518. Removably attached to the arm 520 of microswitch 508 is a paper sensor 521, preferably fabricated from moulded plastic. In use, the presence of paper just above and slightly to the rear of the platen 70 maintains the switch 507 in one switch configuration. When the paper supply is exhausted, the forward contact edge of sensor 521 is released, and an internal bias spring in switch 508 forces arm 520 forward, causing the switch 508 to assume an alternate switch configuration to signify an out-of-paper condition.

It should be understood that switch assembly 500 is designed to sense an out-of-paper condition when the printer is operated in conjunction with an auxiliary tractor feed mechanism (not shown) using conventional edge perforated paper. As is typical with such printer operation, the pressure rollers are maintained in the relaxed position (lever 14 fully forward). When operated in regular platen paper feed mode (lever 14 fully rearward), switch assembly 500 is deactivated by means of an override element 523 having a square aperture 524 received on control rod 72. Element 523 has a switch operating blade portion 526 receivable in a slot 527 formed in adjustment plate 510, so that blade portion 526 biases switch arm 520 rearwardly when rod 72 is in the pressure rollers biased position (lever 14 fully rearward).

Figure 11:
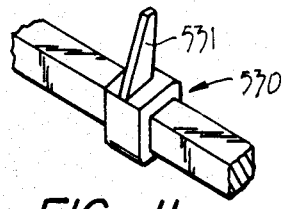
FIG. 11 is an enlarged detail view of an alternate embodiment of the paper out switch override element.

Switch assembly 500 is designed to be supplied as an option for the printer. When the printer is ordered from the factory with this option, the override element 523 of FIG. 10 is used. When the option is added later (i.e., after sale), installation of assembly 500 is facilitated by the use of the modified override element 530 illustrated in FIG. 11. As seen in this Fig., element 530 has a blade portion 531 similar to blade portion 526. The main body portion of element 530, however, is designed in C-shaped fashion to be snap-fitted onto rod 72 from above, thereby avoiding the need to remove rod 72 from the printer in order to install the option.

Figure 13:
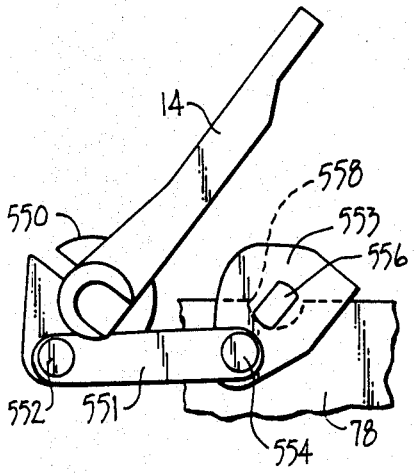
FIGS. 13 and 14 are end views illustrating operation of the mechanism of FIG. 12.
Figure 14:
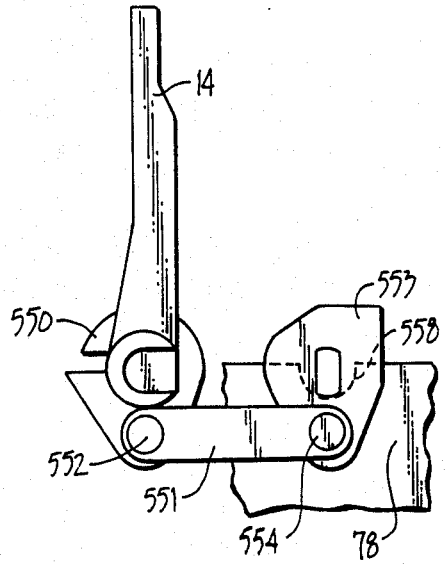
Figure 12:
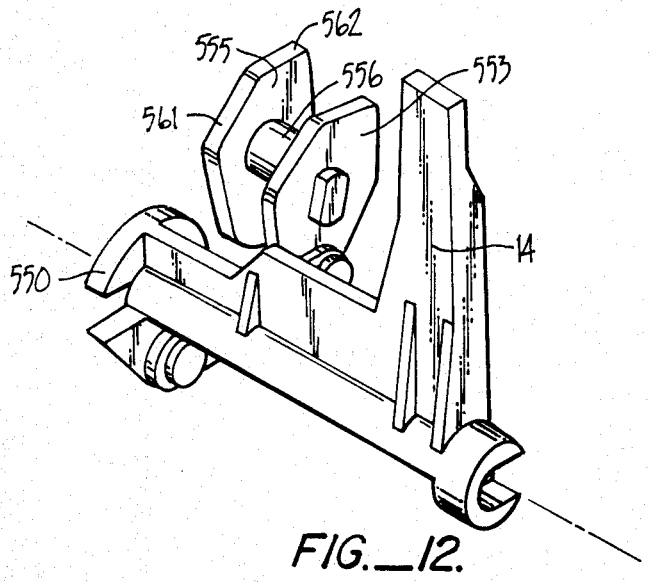
FIG. 12 is an enlarged perspective view of the pressure roller operating lever mechanism.

FIGS. 12–14 illustrate the unique four link pressure roller operating mechanism employed in the preferred embodiment. As seen in these Figs., the one-piece moulded lever 14 has an inner element 550 to the bottom of which a link arm 551 is pivotally attached by means of a rivet 552. The other end of link arm 551 is pivotally attached to a drive plate 553 also by means of a rivet 554. Drive plate 553 is rigidly connected to a camming plate 555 by means of a connector shaft 556 staked at either end to an appropriately shaped aperture in elements 553 and 555. For ease of fabrication, elements 553 and 555 may be identical. Shaft 556 is received in a notch 558 formed in partition 78 to provide rocking support for the shaft 556. Cam plate 555 has a first camming surface 561 which engages surface 147 of lever 146 (FIG. 9) when the lever 14 is in the fully rearward direction and the pressure rollers are engaged; and a second camming surface 562 which bears against the lever surface 147 when the lever 14 is in the fully forward position (pressure rollers released). The manner in which the lever 14 elements mechanically co-act with one another is considered to be self evident from FIGS. 13 and 14.

FIG. 15 illustrates the printer assembly with the carriage assembly installed on the front and rear carriage guide rods 33, 40, and also illustrates the following additional features. The rear carriage guide rod 40 is provided with a rubber bumper 601 at the left-most position which provides a resilient limit stop for carriage motion to the left. A similar bumper (not shown) is provided on the extreme right end of rear carriage guide rod 40.

Figure 17:
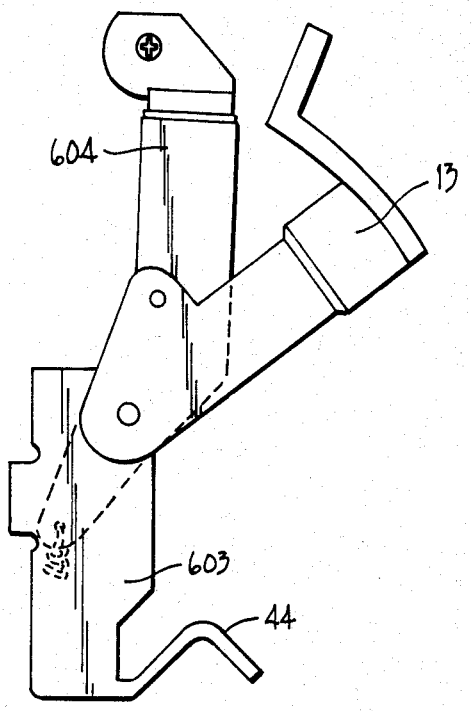
FIG. 17 is an enlarged end view of the paper bail mechanism.

FIGS. 15 and 17 further illustrate the paper bail assembly used in the preferred embodiment. As noted above, the lower support portion 44 of the paper bail brackets provides the keeper for the extreme ends of rear carriage guide rod 40. Rockably attached to each paper bail support bracket 603 is a bail assembly having an end bracket 604 for receiving the ends of the paper bail 605. The left bail element 604 is linked to the bail operating lever 13 by means of a link wire 607 received in mounting apertures 608, 609. When lever 13 is pulled forwardly, the bail 605 is retracted forwardly; similarly, when lever 13 is manipulated rearwardly, bail 605 is placed in the rearward position.

Also seen in FIG. 15 is connector 611 to which ribbon cable 188 is coupled, and which is releasably mounted on the connector platform 220.

Lastly, also evident in FIG. 15 is a supplementary mounting plate 621 having upstanding clip edges 622 for receiving the forward edge of the printer cover (not shown), and which is secured to the forward edge of casting 21 by means of suitable fasteners received through plate apertures 623 and casting apertures 624.

As will now be apparent, the carriage assembly is relatively simple in overall construction and can be readily assembled with a minimum of technical expertise. The eccentric adjustment mechanism affords a range of positional adjustment for the upper and lower carriage assemblies which is more than sufficient. In addition, the eccentric adjustment mechanism is extremely simple to install and use. The cartridge latch is extremely simple in construction, comprising a unitary molded element and provides the necessary latching function while being extremely simple to insall.

While the above provides a full and complete disclosure of the invention, various modifications, alternate constructions and equivalents may be employed without departing from the spirit and scope of the invention. For example, the invention can have application to printers having different printing mechanisms than rotary print wheels. Therefore, the above should not be construed as limiting the invention, which is defined by the appended claims.

What is claimed is:

1. A carriage assembly for a printing device having a print mechanism to be translated along a linear print path, said carriage assembly comprising:

upper carriage means for supporting said print mechanism;

lower carriage means for supporting said upper carriage means, said lower carriage means comprising a unitary member having a pair of laterally spaced arm members each having an open pivot slot and a support ramp portion located rearwardly of said slot, a rear tube portion joining said arm members at the rear, a front cross brace joining said arm members at the front, said rear tube portion being dimensioned to accommodate a first carriage support rod, and front bearing means carried by said front cross brace and dimensioned to accommodate a second carriage support rod so that said lower carriage means is carried by said first and second carriage support rods;

said upper carriage means including a pair of laterally opposed laterally extending support studs, each received in a different one of said pivot slots and removably supported thereby, and a pair of laterally opposed adjustable guide members, each located rearwardly of the respective one of said support studs, said guide members normally engaging corresponding support ramp portions when said carriage assembly is in a first operative position to establish the relative positions of said upper and lower carriage means; and spring means coupled between said upper and lower carriage means in the region adjacent the pivot portions and arranged to provide a spring detent for said upper carriage means with respect to said lower carriage means in said first operative position and in a second inoperative position.

2. The invention of claim 1 wherein said adjustable guide members are eccentric washers.

3. The invention of claim 1 wherein said lower carriage means arms members each includes a laterally extending land portion located adjacent said rear tube portion, and wherein said carriage assembly further includes means for securing a carriage translation belt to said laterally spaced arm members, said securing means including a pair of keeper means each configured to capture an end of the carriage translation belt between the keeper means and the associated land portion when the keeper means are installed.

4. The invention of claim 1 wherein said upper carriage means includes a ribbon drive assembly having an upper platform with at least one cartridge latch aperture, and at least one cartridge latch removably mounted in said platform aperture.

5. The invention of claim 4 wherein said latch comprises a unitary member having a lower flexible upwardly opening U-shaped portion with one leg terminating at an upper end in an outwardly extending flange and the other leg having an outwardly extending keeper nib located below oppositely extending flange portions and spaced therefrom, an upper portion having a cartridge abutment surface, and a relatively stiff web portion joining said upper portion to the top surface of said flange portion.

6. The invention of claim 5 wherein said upper portion of said latch includes a substantially flat floor portion, an upwardly extending angled wall portion joined to said floor portion along an edge, a top portion joined to the upper edge of said wall portion, and a vertical web extending between said top portion and said floor portion.

* * * * *